US005664405A

United States Patent [19]

Perego

[11] Patent Number: 5,664,405

[45] Date of Patent: Sep. 9, 1997

[54] APPARATUS FOR PACKAGING COMPACT DISCS INTO RESPECTIVE CASES AND METHOD FOR PACKAGING COMPACT DISCS INTO RESPECTIVE CASES

[75] Inventor: Luciano Perego, Milan, Italy

[73] Assignee: Tapematic U.S.A., Inc., Orlando, Fla.

[21] Appl. No.: 589,868

[22] Filed: Jan. 23, 1996

[30] Foreign Application Priority Data

Jan. 26, 1995 [EP] European Pat. Off. ..... 95830022

[51] Int. Cl.[6] ..... B65B 5/04; B65B 43/38; B65B 7/26

[52] U.S. Cl. ..... 53/457; 53/458; 53/468; 53/564; 53/284.5; 53/382.1; 53/376.3; 53/377.6

[58] Field of Search ..... 53/458, 468, 492, 53/485, 382.1, 382.2, 385.1, 376.3, 386.1, 564, 457, 284.5, 377.6

[56] References Cited

U.S. PATENT DOCUMENTS

| | | | |
|---|---|---|---|
| 2,918,773 | 12/1959 | Krupp et al. | 53/382.2 X |
| 3,247,646 | 4/1966 | McIntyre | 53/382.2 X |
| 4,149,356 | 4/1979 | Palmer | 53/386.1 X |
| 4,201,027 | 5/1980 | Ilsemann | 53/564 X |
| 4,297,826 | 11/1981 | Woertche | 53/382.2 X |
| 4,365,458 | 12/1982 | Palmer et al. | 53/386.1 X |
| 4,551,966 | 11/1985 | Aoyagi et al. | 53/386.1 X |
| 5,056,770 | 10/1991 | Killguss et al. | 53/382.1 X |
| 5,361,562 | 11/1994 | Nagaoka et al. | 53/492 |

*Primary Examiner*—Horace M. Culver
*Attorney, Agent, or Firm*—Edgar H. Haug; Curtis, Morris & Safford, P.C.

[57] ABSTRACT

An apparatus for packaging compact disc into respective cases along feed line having one station for opening the cases, a first work station in which an informational leaflet and informational booklet are respectively inserted in a housing portion and a lid portion of the case, a second work station in which a compact disc is engaged with a tray, if present, and a cover are respectively inserted in the housing portion and lid portion, and a final station for closing the case. The lid portion of the case is rotated by means of air blowing nozzles positioned at the opening and closing stations, respectively, to direct an air flow against the lid portion.

29 Claims, 3 Drawing Sheets

1
"A"
"B"
"C"
2
3
4
5
6
7
7a
8
9
9a
13
14
14a
15
16
17
17a
18
20
21
22
23
24
25
26
27
28
30
31
32
33
33a
34
35
36
37
38
39
40
41
42
42a
43
44
45
46
46a
47
48
49
50
51

APPARATUS FOR PACKAGING COMPACT DISCS INTO RESPECTIVE CASES AND METHOD FOR PACKAGING COMPACT DISCS INTO RESPECTIVE CASES

FIELD OF THE INVENTION

The present invention relates to an apparatus for packaging compact discs into respective cases of the type having a housing portion on which a lid portion is laterally hinged. The lid portion is movable between a closed condition, wherein the lid portion lies upon the housing portion, and an open condition, wherein the lid portion extends in coplanar relation with the housing portion. This packaging apparatus for compact discs comprises a bearing framework; a case-feeding unit for arranging the cases in succession on a feed line provided on top of the bearing framework; a feeding mechanism operating on the cases received from the case-feeding unit to cause them to progress in a stepping movement along the feed line; an opening station disposed along the feed line and operating on the individual cases to move the respective lid portions from the closed condition to the open condition; at least one work station located downstream of the opening station along the feed line which is provided with a compact disc inserting mechanism to engage at least one compact disc within each case disposed in the open condition; and a closing station operating along the feed line downstream of the work station to move the cases to the closed condition.

The present invention also relates to a packaging method for compact discs performed by the apparatus described above. This method comprises the steps of opening the case by moving the lid portion from the closed condition to the open condition; introducing at least one compact disc into the housing portion of the case; and closing the case by moving the lid from the open condition to the closed condition.

BACKGROUND OF THE INVENTION

It is known that optical discs of the type commercially referred to as "compact discs" and normally used for recording and reproducing sounds and/or images and also for storing data for computers, are generally packaged into cases of transparent plastic material each of which is essentially defined by a housing portion on which a lid portion to be snap-closed is hinged like a book.

More specifically, in one widely used type of case, the compact disc is removably engaged on a so-called "tray" which in turn is mounted by restrained coupling to the housing portion of the case after introducing into the housing portion one leaflet generally including lyrics and/or illustrations (e.g., referring to data or recorded music provided on the compact disc).

A booklet containing further information about the record album and/or the recorded data is also placed in the lid portion. This booklet is engaged with the lid portion by sliding the booklet between the inner surface of the lid portion and appropriate retaining tabs projecting from the inside surface of the lid portion so as to retain the booklet at its opposite edges.

There are several other types of cases distinguishable from the case previously described. For example, in one such prior case, a tray is adapted to receive two compact discs on its opposite faces, while other cases are completely devoid of the tray.

In cases in which there is no tray, the compact disc is removably engaged on retaining lugs directly formed in the housing portion of the case. In this type of compact disc case, the previously mentioned leaflet and booklet are replaced by a single sheet usually referred to as a "cover". Such a cover is engaged internally of the lid portion by insertion of one of its bent edges in a pocket-like seat formed along the pivot edge of the lid portion on the housing portion.

In order to achieve a finished package compact disc, the required operations for packaging compact discs into the respective cases are usually performed with the aid of automatic apparatus, essentially provided with a plurality of work stations suitably distributed along a feed line.

With such an automatic apparatus, the individual cases are received from a feeding magazine of a case feeding unit and are engaged sequentially by a case separation member which causes the cases to progress stepwise along the feed line.

During this movement along the feed line, each case first encounters an opening station wherein, upon the action of a grasping member provided with a suction cup at an end of appropriate mechanical linkage, the case lid portion is moved, by a 180° overturning, from a closed condition, wherein the lid portion lies upon the housing portion of the case, to an open condition, wherein the lid portion extends in a coplanar relation with the housing portion.

Arranged downstream of the opening station is another work station, where the above-mentioned leaflet is introduced and inserted into the housing portion of the case. To achieve this result, an appropriate leaflet insertion mechanism is provided to receive the individual leaflets from a leaflet collection magazine in which the leaflets are arranged in the form of a stack. Each leaflet is then introduced into the housing portion by the insertion mechanism after the leaflet has been suitably shaped by means of an appropriate bending mold.

Subsequently, the cases are transferred to two further work stations wherein a tray is inserted into the housing portion of each case and then in succession engaged in the case by a restrained coupling. In another work station, one booklet is disposed on the inner face of the case lid portion, and afterwards each case is transferred to a further work station wherein a compact disc is brought into engagement with the tray disposed in the housing portion. Each case along the feed line is finally transferred to a closing station wherein, with the aid of a pusher element operated by an appropriate driving mechanism, the lid portion is moved from the open condition to the closed condition.

In the packaging apparatus of the above-described type, movement of the grasping members and pusher elements located in the opening and closing stations and operation of most of the movable members provided in all of the work stations are achieved by a mechanical transmission.

As a result, since it is necessary to impart a 180° rotation to the lid portion in order to move it between the closed and open conditions, the mechanical linkages for transmitting all of these movements is necessarily of a very complicated structural construction. In addition, these mechanical linkages must operate in a very precise manner in that the compact disc cases are usually made of a plastic material which is easily breakable.

As a result thereof, the mechanical components of the prior compact disc packaging apparatus for opening and closing the cases are themselves very complicated in nature, thereby leading to higher production costs and also enhanced servicing and start-up costs.

In addition, the above-described apparatus of the known art are very bulky and their construction involves high costs because each of the operations provided in the packaging cycle requires the presence of a specific work station along the feed line. Besides the work stations for respectively carrying out the insertion of the leaflets, trays, booklets and compact discs, further work stations must be provided although they are likely to be often inactive. In fact, such stations are equipped with the appropriate devices only in case of need, for example, for performing either the insertion of a second compact disc if trays intended for supporting two compact discs are used, or for the insertion of the so-called "cover" if cases adapted to directly receive the compact discs are used (that is, cases which do not require insertion of the tray, the leaflet and the booklet).

OBJECTS AND SUMMARY OF THE INVENTION

Accordingly, it is an object of the present invention to provide an apparatus for packaging compact discs into respective cases and a method for packaging compact discs into respective cases which avoids the disadvantages of the prior art.

An additional object of the present invention is to provide an apparatus for packaging compact discs into respective cases wherein the opening and closing operations of the case are accomplished in a greatly simplified manner in comparison with the known art.

A further object of the present invention is to provide an apparatus for packaging compact discs into respective cases wherein the cooperation between all of the individual machines necessary for assembling the different components for the finished compact disc case is achieved in relatively few work stations so that the overall dimensions and the production costs of the apparatus as a whole are greatly reduced.

The foregoing and further objects that will become more apparent as a result of the present description are achieved by an apparatus for packaging compact discs into respective cases having stations for opening and closing the lid portion of the case with respect to the housing portion wherein at least one of opening and closing stations comprises at least one air blowing nozzle arranged to direct an air flow against the lid portion in order to cause movement of the lid portion between its closed and open conditions.

In accordance with the present invention, this apparatus achieves a new method of packaging compact discs into the respective cases wherein in at least one of the steps of opening and closing the case, an air flow is directed against the lid portion of the case so as to obtain at least a partial displacement of the case between its open condition and its closed condition.

Various other objects, advantages and features of the present invention will become readily apparent from the ensuing detailed description, and the novel features will be particularly pointed out in the appended claims.

BRIEF DESCRIPTION OF THE DRAWINGS

The following detailed description, given by way of example, will best be understood in conjunction with the accompanying drawings in which.

DETAILED DESCRIPTION OF CERTAIN PREFERRED EMBODIMENTS

Figure 1:
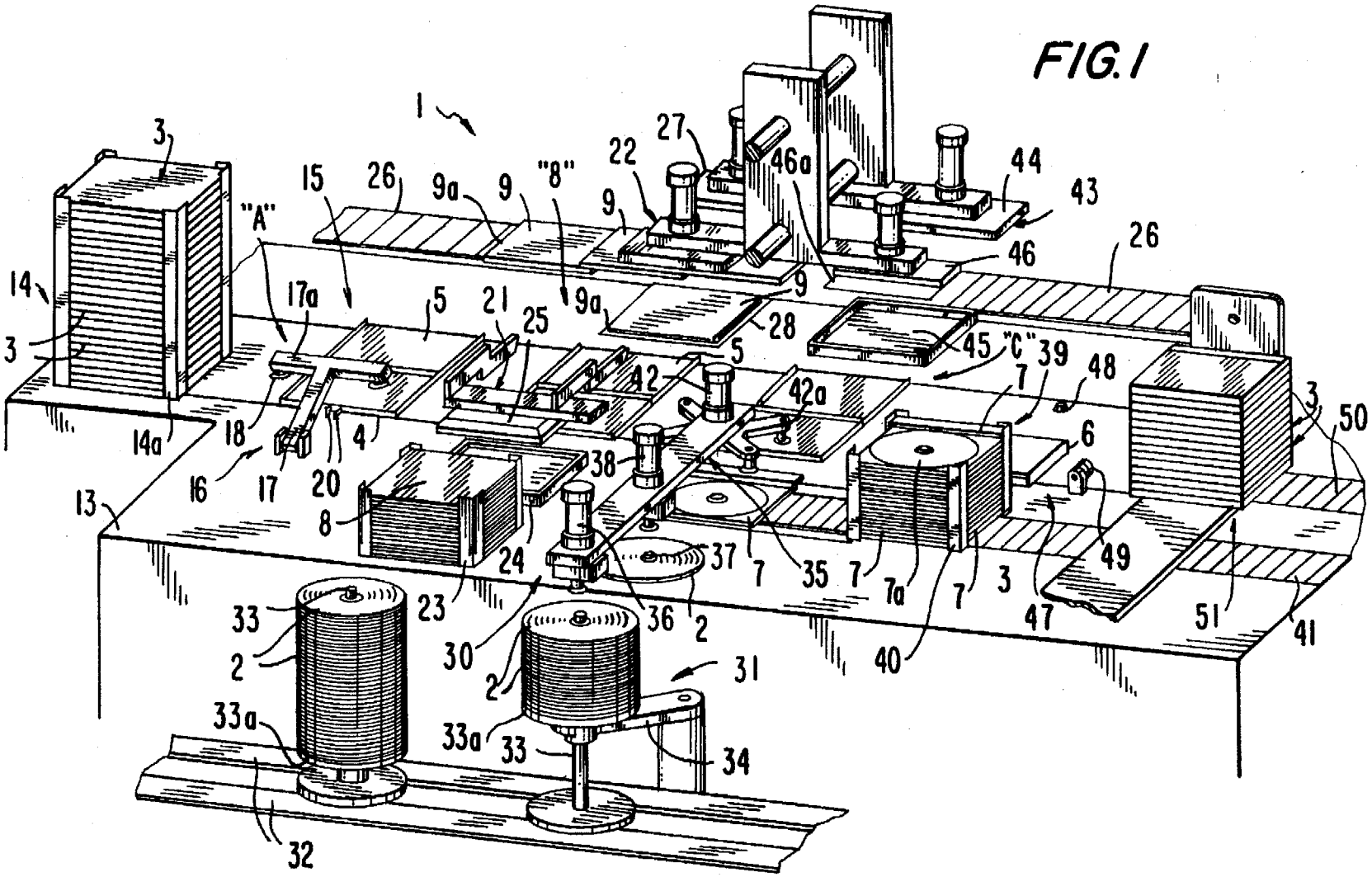
FIG. 1 is a perspective view diagrammatically illustrating a preferred embodiment of an apparatus for packaging compact discs into respective cases in accordance with the teachings of the present invention.

Referring now to the drawings, wherein like reference numerals are used throughout and in particular to FIG. 1, there is illustrated a preferred embodiment of an apparatus for packaging compact discs into respective cases in accordance with the present invention.

In FIG. 1, this packaging apparatus has been generally identified by reference numeral 1 and is intended for selectively packaging compact discs 2 into two different types of cases 3.

Figure 4:
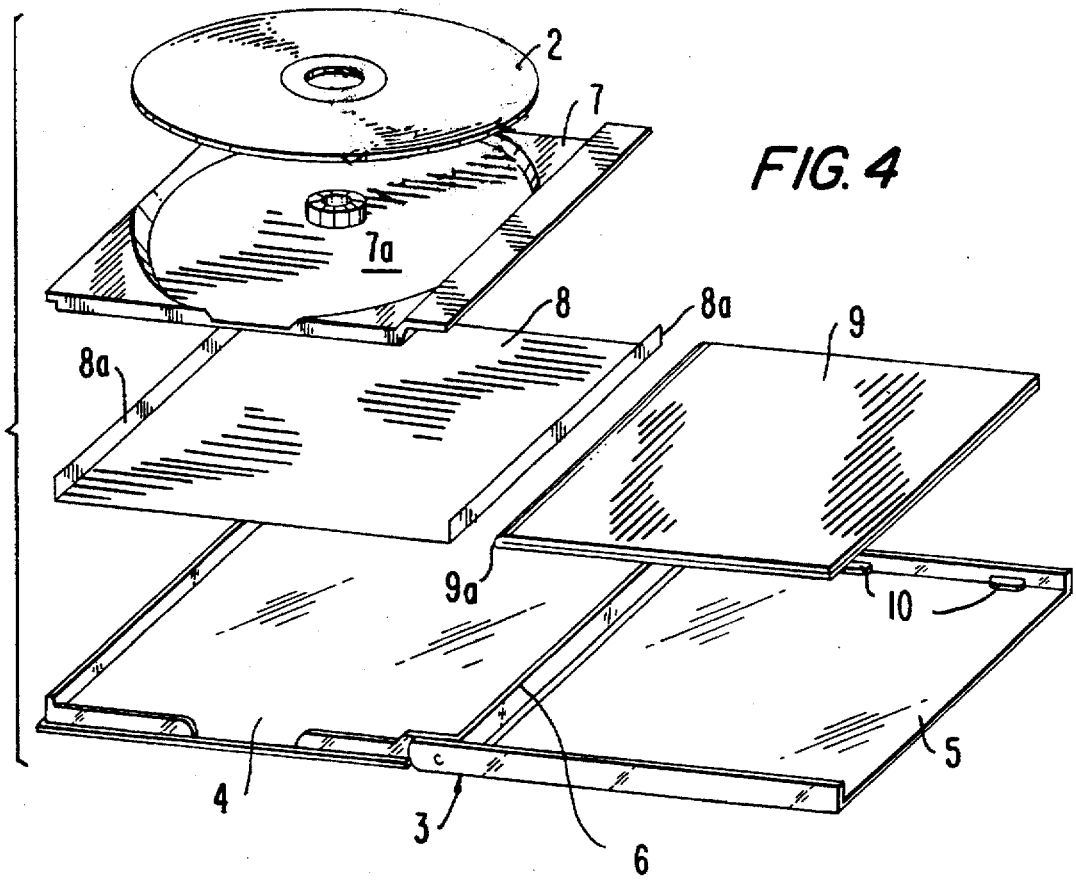
FIG. 4 is an exploded perspective view of one type of compact disc case to be assembled by the packaging apparatus of the present invention.

The first type of case 3, as best shown in FIG. 4, comprises a housing portion 4 and a lid portion 5 made of transparent plastic material which are rotatably connected to each other at a common hinging side 6.

In the case 3 of FIG. 4, a tray 7 is fitted by restrained coupling in the housing portion 4. This tray 7 is provided with at least one engagement seat **7*a* for receiving a compact disc 2. A leaflet 8 reproducing lyrics and/or images referring to the data or the recorded music contained in the compact disc is interposed between the tray 7 and the inner surfaces of the housing portion 4**.

Further information is contained in a booklet 9 positioned on the inner surface of the lid portion 6. This booklet 9 is secured to the inner surface of the lid portion 6 by means of tabs and/or other retaining lugs 10 for maintaining the booklet conveniently in place.

Figure 5:
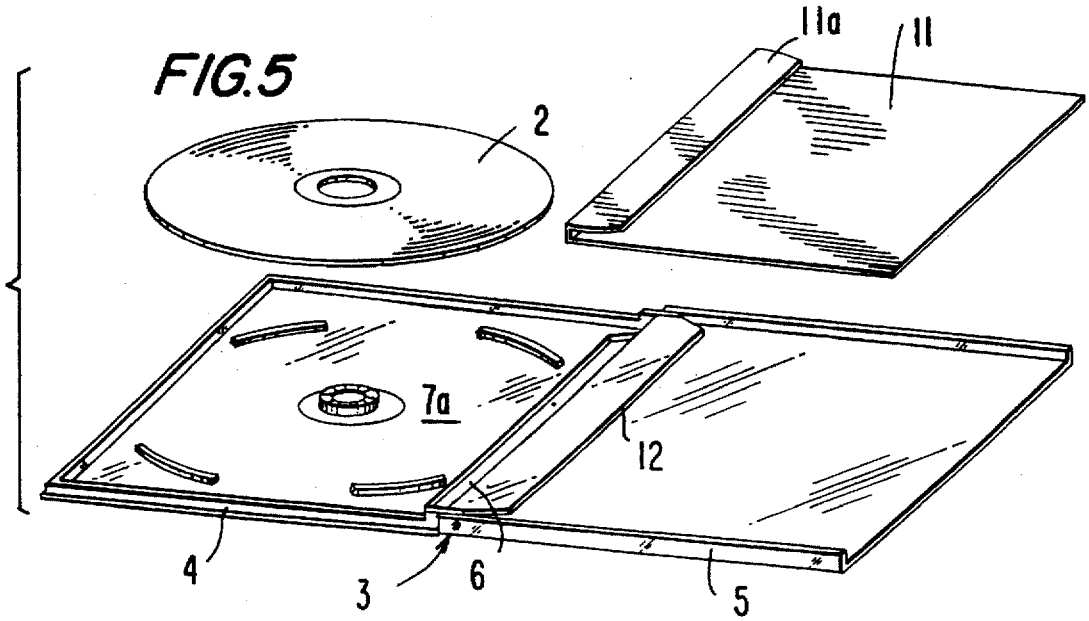
FIG. 5 is an exploded perspective view of a second type of compact disc case to be assembled by the packaging apparatus of the present invention.

A second type of case 3 is specifically illustrated in FIG. 5. In the case 3 of FIG. 5, the engagement seat **7*a* for the compact disc 2 is of a one piece construction with the inner surfaces of the housing portion 4. This type of case 3 is therefore devoid of the tray 7 and the above-mentioned leaflet 8 and booklet 9 are replaced by a single cover 11 having a U-shaped/bent end border 11*a*. This border 11*a* is inserted in a pocket-like seating 12 formed on the hinging side 6 of the lid portion 5**.

As shown in FIG. 1, the packaging apparatus 1 of the present invention comprises a bearing framework 13 on which a case-feeding unit 14 is operatively mounted. The case-feeding unit 14 cyclically transfers the individual cases 3 to the feed line, as indicated marked by arrow "A" in FIG. 1 which is provided on the bearing framework. For clarity purposes, as shown in FIG. 1, this feeding unit includes a feeding magazine **14*a* containing a predetermined number of empty cases 3** disposed consecutively so as to form a stack. The cases are individually removed from the bottom of the magazine by a case separation member (not shown) and are thereafter transferred to the feed line "A".

A conveying mechanism (not shown) is provided to move the cases in a stepped, sequential motion along the feed line "A".

Figure 2:
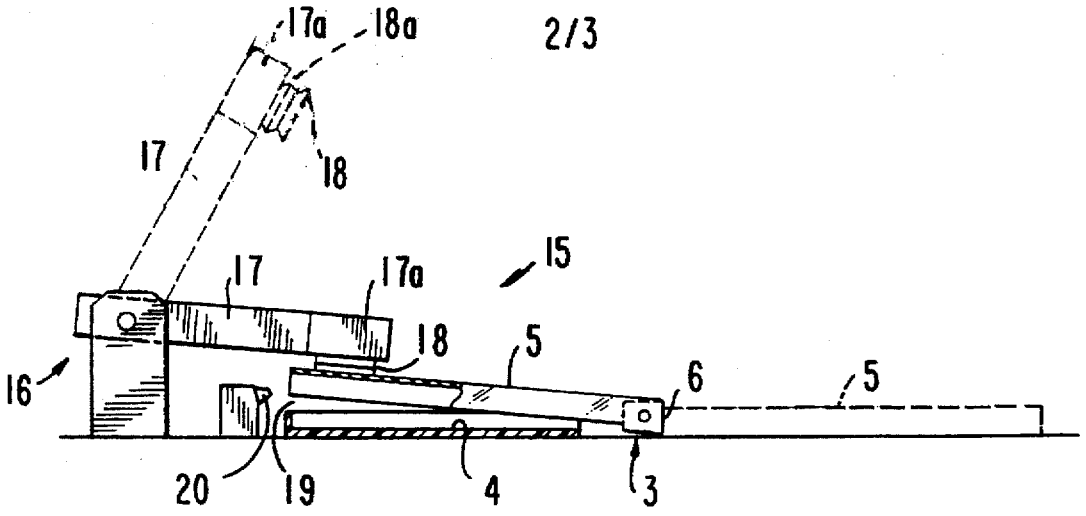
FIG. 2 is a side elevational view of the components of an opening station of the apparatus of FIG. 1 for the purpose of opening the lid portion of each case.
Figure 3:
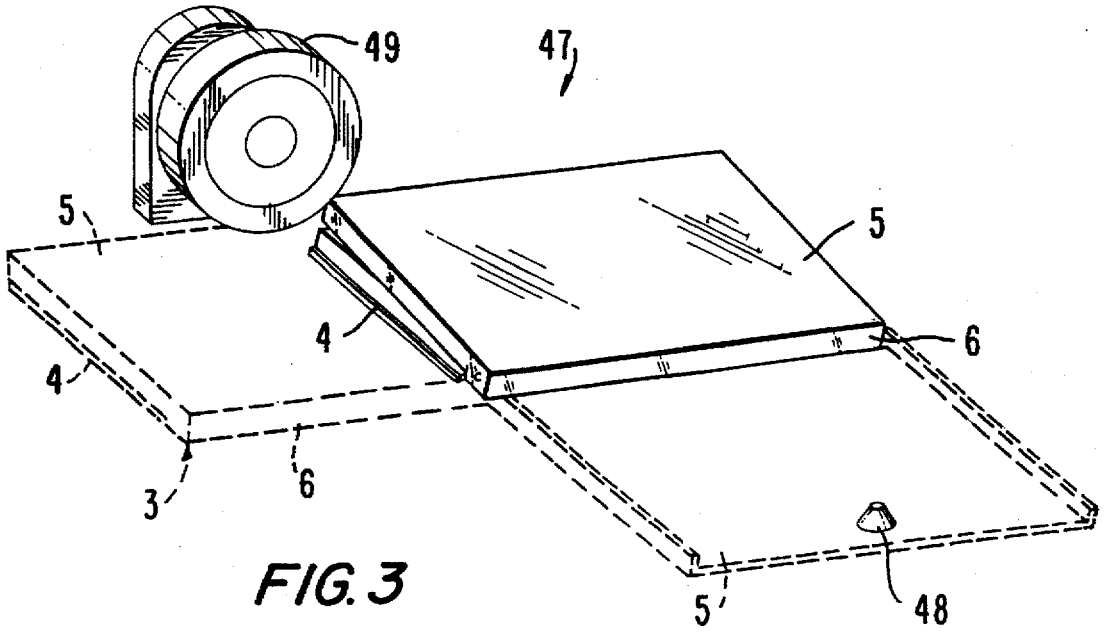
FIG. 3 is a side elevational view of the components of the closing station of the apparatus of FIG. 1 for closing the lid portion of each case.

During this movement along the feed line "A", each case 3 first encounters an opening station, generally denoted by 15, wherein the lid portion 5 is opened with respect to the housing portion 4. As shown in FIG. 1, the opening station 15 includes a lifting mechanism 16 preferably having at least one driving arm 17 rotatably mounted about a horizontal axis of the bearing framework 13. As best shown in FIG. 2, this driving arm 17 has an end portion 17*a* on which one or more grasping members are mounted. These grasping members are preferably in the form of suction cup elements 18 provided with respective bellows-like portions 18*a* so that the suction cup elements are fastened to the end portion 17*a* of arm 17.

Upon the actuation of a fluid-operated actuator (not shown), the driving arm 17 is oscillatably movable about an axis parallel to the hinging side 6 of the case between a rest condition, wherein, as shown in dotted line in FIG. 2, the end portion 17*a* of the arm 17 is spaced away from the case 3 positioned on the feed line "A", and an operating position, wherein the suction cup elements 18 engages the lid portion 5 of the case. Once the driving arm 17 has reached its operating position, a suction action is created by the suction cup elements 18 so that, as a result of the resulting axial deformation of the suction cup elements at the bellows-like portions 18*a*, the lid portion 5 is moved from a closed condition, wherein the lid portion lies upon the housing portion 4, to a half-closed condition, wherein the lid portion 5 is slightly separated from the housing portion 4. In this half-closed condition, a restricted opening 19 is defined between the lid portion 5 edge and the edge of the housing portion 4 opposite to the hinging side 6 of the case.

The retaining force of the suction cup elements 18 lifting the lid portion 5 can be assisted advantageously by utilizing one or more auxiliary suction cups (not shown) fastened to the bearing framework 13 along the feed line "A" which provide a suction force to the lower surface of the housing portion 4 to stably fix the positioning of the housing portion before the lid portion is subjected to the suction cup elements 18 to move the lid portion to the half-closed condition. These auxiliary suction cups can be connected to a respective circuit for creating a vacuum therein (not shown).

At least one air flow nozzle 20 is provided in the opening station 15 oriented inwardly toward the small opening 19 to direct an air flow against the inner surface of the lid portion 5. Upon the force applied to the lid portion as a result of this air flow, the lid portion 5 is advantageously rotated and is moved from the half-closed condition to an open condition wherein the lid portion 5 extends in coplanar relation with the housing portion 4. Rotation of the lid portion 5 occurs after the suction cup elements 18 have been deactivated and the driving arm 17 is moved towards its rest condition. The progressive removal of the suction cup elements 18 from the lid portion 5 advantageously accompanies the beginning of rotation of the lid portion 5, that is, when the air flow produced by the air flow nozzle 20 is strongest, the lid portion 5 is prevented from being rotated too abruptly.

When the lid portion 5 is completely opened with respect to the housing portion 4, the conveying mechanism removes the case 3 from the opening station 15 and conveys the case along the feed line "A" to one or more work stations "B" and "C", wherein assembling of the different components of the case is performed to create a finished compact disc case. More particularly, if the finished packaging case 3 is the type of case illustrated in FIG. 4, the leaflet 8, the booklet 9, the tray 7 and the compact disc 2 are inserted into the case 3, whereas if the finished packaging case is the type of case illustrated in FIG. 5, only the compact disc 2 and cover 11 are introduced thereinto.

For the above operations, the case 3 is advantageously transferred from the opening station 15 to a first work station "B" by the conveying mechanism performing one movement step. As shown in FIG. 1, a leaflet inserting mechanism 21 for inserting the leaflets into the case and a booklet inserting mechanism 22 for inserting the booklets into the case are provided at the first work station "B" at respectively opposite sides of the feed line "A".

The leaflet-inserting mechanism 21 includes a magazine 23 in which the leaflets 8 are stacked upon each other. The leaflets 8 are individually removed from the bottom of the stack in the magazine 23, as a result of grasping members (not shown) and transferred to a shaping mold 24 positioned adjacent the feed line "A". The leaflet-inserting mechanism 21 further includes a plate-like countermold 25 which is movable, in response to command of actuators (not shown), both in a vertical direction and in a horizontal direction perpendicular to the feed line "A". This plate-like countermold 25 can be introduced vertically into a shaping mold 24 to create a fold along the two side flaps 8*a* of the leaflet 8. The countermold 25 is then subsequently raised and moved horizontally to move the leaflet over the housing portion 4 of the case 3 located at the first work station "B". In this position, when the countermold 25 is moved downwardly, the leaflet 8 is inserted into the housing portion 4 of the case. The countermold is then moved away from the case 3 into a position over the shaping mold 24, and meanwhile, a new leaflet 8 has been received therein for processing. The leaflets 8 are received and released by the countermold 25 by means of ducts (not shown) formed as openings within the lower surface of the countermold and through which a suction action can be selectively started and interrupted to enable retention and release of each leaflet 8.

The booklet-inserting mechanism 22 in turn provides for the booklets 9 to be moved to the first work station "B" by a belt conveyor 26 which extends parallel to the feed line "A". As the cases approach work station "B", the individual booklets 9 are received by the belt conveyor 26 by means of a grasping member 27 movable in a vertical and a horizontal direction, and also rotatable about a vertical axis, in response to actuators (not shown).

The grasping member 27 is adapted to pick up the booklet 9 and, upon rotation of the grasping member 27, if necessary, positioning its back edge 9*a* towards the case 3. In this manner, the booklet 9 is laid down onto a platform 28 disposed adjacent to the feed line "A" on the opposite side thereof relative to the shaping mold 24.

A second grasping member 22 movable along two axes, in the same manner as the plate-like countermold 25, receives the booklet 9 from the platform 28 and inserts the booklet between the inner surface of the lid portion 5 and the retaining tabs 10 associated therewith. A pair of guide blocks 29 which may be linked to the plate-like countermold 25 ensures the correct placement of the booklet edges 9 under the retaining tabs 10, thereby preventing the tabs from being undesirably passed over the edges of the booklet 9.

Obviously, the leaflet inserting mechanism 21 and the booklet inserting mechanism 22 arranged in the first work station "B" are activated during the packaging of compact discs 2 into cases 3 of the type shown in FIG. 4, whereas the leaflet inserting mechanism and booklet inserting mechanism are inactive if the compact discs 2 are to be packaged into cases 3 of the type devoid of a tray 7, such as shown in FIG. 5.

A second work station "C" is provided downstream of the first work station "B" which includes a compact disc inserting mechanism generally denoted by 30. The compact disc inserting mechanism 30 includes a compact disc feeding unit 31 adapted to individually arrange the compact discs 2 at a predetermined grasping position. As a result thereof, the feeding unit 31 is comprised of a second belt conveyor 32, extending horizontally at a lower position than the feed line "A", and along which one or more loading spindles 33 are arranged. Each spindle carries a predetermined number of compact discs 2 which are inserted over a vertical rod 33*a* of the spindle. The loading spindle 33 is aligned with the second work station "C", such that a lifting fork 34 is introduced under a support plate associated with the spindle, to lift the compact disc stack until the uppermost compact disc 2 reaches the desired grasping position, preferably coplanar with the feed line "A".

The compact disc inserting mechanism 30 also includes a disc transferring unit 35 movable with a reciprocating motion in a direction perpendicular to the feed line "A". The disc transferring unit 35 includes a first grasping head 36 movable in a vertical direction and designed to receive the compact disc 2 by means of a suction effect produced through ducts opening provided in the lower surface thereof, and subsequently position the compact disc 2 on a centering pin 37 mounted to the bearing framework 13. A second grasping head 38, similar to the first head 36, is provided which is adapted to receive the compact disc 2 from the centering pin 37 and transfer it to an assembling position where, if packaging into cases 3 of the type illustrated in FIG. 4, a tray 7 is positioned in the case which has been transferred to that position by a tray-feeding unit generally denoted by 39.

The tray-feeding unit 39 includes a tray-holding magazine 40 in which the trays 7 are vertically stacked so that they can be picked up one by one starting from the lower end of the stack upon the action of a first transferring mechanism (not shown). As illustrated in FIG. 1, the tray-feeding unit 39 also includes a second transferring mechanism having an auxiliary belt conveyor 41 extending in parallel relation to the feed line "A" which is adapted to be used for positioning the trays 7 from the feeding unit into an assembling position. In particular, the auxiliary belt conveyor 41 can be used for feeding trays 7 of the type usually provided with two engagement seats 7*a* on opposite faces for receiving two compact discs 2. In this case, the trays 7 transferred by the auxiliary belt conveyor 41 are trays 7 already provided with one compact disc 2 previously supplied by a separate equipment and optionally connected to the apparatus 1 by another belt conveyor mechanism or the like.

A third grasping head 42 associated with the transferring unit 35 receives the compact disc 2 from the assembling position and transfers it into the housing portion 4 of the case 3. If cases 3 of the type illustrated in FIG. 5 are utilized, the tray-feeding unit 39 remains inactive and the third head 42 receives from the assembling position, only the compact disc 2 which will be directly introduced into the housing portion 4 of the case.

If the cases 3 being processed are of the type illustrated in FIG. 4, the compact disc 2 positioned in the assembling position is moved into engagement with the seat 7*a* of the tray 7 upon the action of the second grasping head 38. Subsequently, the tray 7 is transferred together with the compact disc 2 into the housing portion 4, upon the action of the third grasping head 42.

Thrust arms 42*a* can also be associated advantageously with the third grasping head 42. Upon insertion of the compact disc 2 and tray 7 into the housing portion 4, the thrust arms 42*a* exert a thrust action upon opposite corners of the tray 7 to ensure the correct engagement position of the tray 7 within the case 3.

Advantageously, a cover-inserting mechanism identified by reference numeral 43 in FIG. 1 is also associated with the second work station "C". The cover-inserting mechanism 43 operates at a symmetrically opposite position relative to the compact disc-inserting mechanism 30 and is adapted to be operated selectively and alternatively in response to operation of the leaflet-inserting mechanism 21, booklet-inserting mechanism 22 and tray-feeding unit 39, in order to place a cover 11 on the inner face of the case lid 3, when the case 3 is of the type devoid of trays 7, as shown in FIG. 5.

In order to achieve this result, the cover-inserting mechanism 43 essentially causes the first belt conveyor 26 to transfer the covers 11 to the second work station "C", instead of transferring the booklets 9. An auxiliary grasping member 44, similar in structure and operation to the grasping member 27 previously described with reference to the booklet-feeding mechanism, receives the individual covers 11 from the belt conveyor 26 and, after a rotation about a vertical axis if necessary, lays them onto a bending mold 45 disposed alongside the feed line "A". A front edge 46*a* of an auxiliary countermold 46 which conforms in shape to the pocket-like seating 12 is lowered onto the bending mold 45 and causes the end border 11*a* of the cover 11 initially disposed in a flat configuration to be bent upwardly, as a result of the force applied by the auxiliary countermold 46. The cover 11 with its border 11*a* bent upwardly is then moved away from the bending mold 45 and is positioned on the inner surface of the lid 5. During this step, the front edge 46*a* of the auxiliary countermold 46 enters the pocket-like seating 12 forcing the end border 11*a* of the cover 11 to take an "U-shaped" bent configuration conforming to the pocket-like seating itself.

A closing station 47 is provided along the feed line "A" downstream of the second work station "C". At the closing station, the lid portion 5 is returned to its closed condition.

Advantageously, the closing station 47 includes at least one second air blowing nozzle 48 fastened to the bearing framework 13 which is designed to direct an air flow against the lid portion 5 to move the lid portion from the open condition to the half-closed condition.

A presser mechanism is also associated with the closing station 47 which impinges upon the lid portion 5 when the lid portion is in its half-closed condition to push the lid portion towards the housing portion 4, so that the lid portion will return to its closed condition. In this manner, the resistance of snap-closing mechanism conventionally interposed between the housing portion and the lid portion is unnecessary.

In a preferred embodiment, the presser mechanism is formed of an idle roller 49 rotatably supported on the bearing framework 13 about an axis perpendicular to the translational movement imparted to the case 3 by the conveyor mechanism. The idle roller 49 impinges upon the lid portion 5 as soon as the case 3 is displaced from the closing station 47 by the conveyor mechanism.

The cases 3 exiting the closing station 47 can be removed from the packaging apparatus 1 by an outfeed conveyor 50, and/or stacked upon each other by a stacker 51. In one preferred embodiment, the presence both of the outfeed conveyor 50 and the stacker 51 is provided and they are employed selectively for removing the finished products and respectively arranging defective products in a stack or vice-versa.

As a result of the present invention, the opening and/or closing of the case lid portion is achieved by an apparatus which is greatly simplified in structure as compared with those of the known art.

Moreover, rotation of the lid portion to the open and/or closed position, obtained by an air flow, advantageously overcomes all the difficulties present in the known art as a result of the necessity of mechanically forcing the lid to rotate in an angular travel through 180° in a very short period of time (on the order of a few fractions of one second), while contemporaneously accomplishing closing and opening of the lid portion with refined force and preciseness in order to prevent damage to the case and/or breakage of same.

It should be also recognized that since the components described herein utilized to insert the leaflets, booklets, covers and compact discs are concentrated in two work stations and at mutually opposite positions with respect to the feed line, an enhanced versatility of the apparatus is achieved, while at the same time reducing the bulkiness of the overall apparatus.

While the present invention has been particularly shown and described with reference to a preferred embodiment, it will be readily apparent to those of ordinary skill in the art that various changes and modifications may be made therein without departing from the spirit and scope of the invention. It is intended that the appended claims be interpreted as including the foregoing as well as various other such changes and modifications.

What is claimed is:

1. An apparatus for packaging compact discs into respective cases, the cases being of the type having a housing portion on which a lid portion is laterally hinged at a hinging side thereof, the lid portion being movable between a closed condition, wherein the lid portion lies upon the housing portion, and an open condition, wherein the lid portion extends in a coplanar relation with the housing portion, said apparatus comprising:

a bearing framework;

a case feeding unit for arranging the cases in succession on a first feed line provided on said bearing framework;

conveying means for sequentially moving the cases along said first feed line;

lid portion opening means disposed along said first feed line for moving the lid portion of each case moving along said first feed line from its said closed condition to its said open condition;

means for inserting a compact disc within each case provided along said first feed line when said case is in its open condition;

means for closing said lid portion of said case to move said lid portion from its said open condition to its said closed condition; and wherein at least one of said lid portion opening and closing means comprises means for blowing air against the lid portion in order to move the lid portion between its open and closed conditions.

2. The apparatus as claimed in claim 1, wherein said lid portion means includes a first air blowing nozzle of said air blowing means for directing an air flow against the lid portion of the case, said lid portion opening means further including lifting means for engaging and lifting said lid portion which in cooperation with said first air blowing nozzle move the lid portion from its closed condition to a half-closed condition wherein the lid portion is slightly separated from the housing portion of the case.

3. The apparatus as claimed in claim 2 wherein said first air blowing nozzle is oriented toward the inside of a restricted opening defined between an edge of the lid portion and an edge of the housing portion opposite to the hinging side of the case.

4. The apparatus as claimed in claim 2, wherein said lifting means comprises at least one grasping member provided at an end portion of a driving arm which is movable between a rest position, wherein said grasping member is moved away from the lid portion, and an operating position, wherein said driving arm has its end portion overlying said lid portion in its closed condition so that said grasping member is in a position to engage the lid portion.

5. The apparatus as claimed in claim 4, wherein said driving arm oscillates between the rest position and the operating position about an axis parallel to the hinging axis between the lid portion and the housing portion of the case.

6. The apparatus as claimed in claim 4, wherein said grasping member comprises at least one axially deformable suction cup element to a suction force to the lid portion to cause movement of the lid portion to the half-closed condition.

7. The apparatus as claimed in claim 1, wherein said lid portion closing means comprises at least one second blowing nozzle of said air blowing means for directing an air flow against the lid portion to move the lid portion from its open condition to the half-closed condition in which the lid portion is slightly separated from the housing portion of the case, and presser means for exerting a force on the lid portion to move the lid portion from its half-closed condition to its closed condition by a thrust action directed towards the housing portion of the case.

8. The apparatus as claimed in claim 1, wherein said presser means comprises at least one idle roller rotatably supported about an axis perpendicular to the translational direction of movement of the case along said first feed line downstream of said lid portion closing means for impinging upon the lid portion to move the lid portion to its closed condition.

9. The apparatus as claimed in claim 1, and further comprising leaflet inserting means for introducing at least one leaflet into the housing portion of the case when the case is in its open condition, and booklet inserting means operating in a symmetrically opposite position along said first feed line with respect to said leaflet inserting means for placing at least one booklet into engagement with an inner face of said lid portion.

10. The apparatus as claimed in claim 9, and further including compact disc inserting means provided along the first feed line downstream of said leaflet inserting means and booklet inserting means.

11. The apparatus as claimed in claim 10, and further including cover inserting means operating in a symmetrically opposite position with respect to said compact disc inserting means for positioning a cover into engagement with an inner face of the lid portion, said cover inserting means being operable selectively and alternatively in response to the operation of the leaflet inserting means and booklet inserting means.

12. The apparatus as claimed in claim 10, wherein said compact disc inserting means comprises:

a compact disc feeding unit to arrange the compact discs individually at a predetermined grasping position;

a tray feeding unit to place at a predetermined coupling position in each said case at least one tray provided with an engagement seat for a compact disc;

a transferring unit reciprocating in a direction transverse to the movement of said first feed line and carrying a first grasping head for receiving a compact disc from the grasping position and fitting the compact disc on a centering pin mounted to said bearing framework, said transferring unit further including a second grasping head designed to receive the compact disc from said centering pin and engaging the compact disc with the engagement seat of the tray disposed in the coupling position to provide a compact disc tray assembly and a third grasping head for receiving the compact disc tray assembly and introducing the compact disc assembly into the housing portion of the case.

13. The apparatus as claimed in claim 12, wherein said cover feeding means can be activated selectively and alternatively in response to the activation of said tray feeding unit.

14. The apparatus as claimed in claim 12, wherein said tray feeding unit comprises first transferring means for receiving the individual trays from a tray holding magazine in which said trays are disposed in a stack, and second transferring means to be activated selectively and alternatively in response to activation of said first transferring means for positioning each said tray in an assembling position.

15. An apparatus for packaging compact discs into respective cases, the cases being of the type having a housing portion on which a lid portion is laterally hinged at a hinging side thereof, the lid portion being movable between a closed condition, wherein the lid portion lies upon the housing portion, and an open condition, wherein the lid portion extends in a coplanar relation with the housing portion, said apparatus comprising:

a bearing framework;

a case feeding unit for arranging the cases in succession on a first feed line provided on said bearing framework;

conveying means for sequentially moving the cases along said first feed line;

lid portion opening means disposed along said first feed line for moving each case along said first feed line from its said closed condition to its said open condition;

leaflet inserting means for introducing at least one leaflet into the housing portion of the case when the case is in its open condition;

booklet inserting means operating in a symmetrically opposite position with respect to said leaflet inserting means for disposing at least one booklet into engagement with an inner face of said lid portion;

means for inserting a compact disc within each said case provided along said first feed line when said case is in its open condition;

cover inserting means operating in a symmetrically opposite position with respect to the compact disc inserting means for positioning a cover into engagement with an inner face of the lid portion;

means for closing said lid portion of said case to move said lid portion from its said open condition to its said closed condition; and wherein at least one of said lid portion opening and closing means comprises means for blowing air against the lid portion in order to move the lid portion between its open and closed conditions.

16. The apparatus as claimed in claim 15, wherein said lid portion opening means includes a first air blowing nozzle of said air blowing means for directing an air flow against the lid portion of the case, said lid portion opening means further including lifting means for engaging and lifting the lid portion which in cooperation with said first air blowing nozzle move the lid portion from its closed condition to half-closed condition wherein the lid portion is slightly separated from the housing portion of the case.

17. The apparatus as claimed in claim 16, wherein said first air blowing nozzle is oriented toward the inside of a restricted opening defined between an edge of the lid portion and an edge of the housing portion opposite to the hinging side of the case.

18. The apparatus as claimed in claim 16, wherein said lifting means comprises at least one grasping member provided at an end portion of a driving arm which is movable between a rest position, wherein said grasping member is moved away from the lid portion, and an operating position, wherein said driving arm has its end portion overlying said lid portion in its closed condition so that said grasping member is in a position to engage the lid portion.

19. The apparatus as claimed in claim 18, wherein said driving arm oscillates between the rest position and the operating position about an axis parallel to the hinging axis between the lid portion and the housing portion of the case.

20. The apparatus as claimed in claim 18, wherein said grasping member comprises at least one axially deformable suction cup element to apply a suction force to the lid portion to cause movement of the lid portion to the half-closed condition.

21. The apparatus as claimed in claim 15, wherein said lid portion closing means comprises at least one second blowing nozzle of said air blowing means for directing an air flow against the lid portion to move the lid portion from its open condition to the half-closed condition in which the lid portion is slightly separated from the housing portion of the case, and presser means for exerting a force on the lid portion to move the lid portion from its half-closed condition to its closed condition by a thrust action directed towards the housing portion of the case.

22. The apparatus as claimed in claim 21, wherein said presser means comprises at least one idle roller rotatably supported about an axis perpendicular to the translational direction of movement of the case along said side first feed line downstream of said lid portion closing means for impinging upon the lid portion to move the lid portion to its closed condition.

23. The apparatus as claimed in claim 15, wherein said cover-inserting means is operable selectively and alternatively in response to the operation of the leaflet-inserting means and booklet-inserting means of said first work station.

24. The apparatus as claimed in claim 15, wherein said compact disc inserting means comprises:

a compact disc feeding unit to arrange the compact discs individually at a predetermined grasping position:

a tray feeding unit to place at a predetermined coupling position in each said case at least one tray provided with an engagement seat for a compact disc;

a transferring unit in a direction transverse to the movement of said first feed line and carrying a first grasping head for receiving a compact disc from the grasping position and fitting the compact disc on a centering pin mounted to said bearing framework, said transferring unit further including a second grasping head designed to receive the compact disc from said centering pin and engaging the compact disc with the engagement seat of the tray disposed in the coupling position to provide a compact disc tray assembly and a third grasping head used for receiving the compact disc tray assembly and introducing the compact disc tray assembly into the housing portion of the case.

25. The apparatus as claimed in claim 24, wherein said cover feeding means can be activated selectively and alternatively in response to the activation of said tray feeding unit.

26. The apparatus as claimed in claim 24, wherein said tray feeding unit comprises first transferring means for receiving the individual trays from a tray holding magazine in which said trays are disposed in a stack, and second transferring means to be activated selectively and alternatively in response to activation of said first transferring means for positioning each said tray in an assembling position.

27. A method of packaging compact discs into respective cases, said cases being of the type having a housing portion on which a lid portion is laterally hinged at a hinging side thereof, the lid portion being movable between a closed condition, wherein the lid portion lies upon the housing portion, and an open condition, wherein the lid portion extends in a coplanar relation with the housing portion, said packaging method comprising the steps of:

opening each case by moving the lid portion from its closed condition to its open condition;

introducing at least one compact disc into the housing portion of the case;

closing the case by moving the lid portion from its open condition to its closed condition, wherein the movement of the lid in at least one of said steps of opening and closing the case comprises the step of directing air against said lid portion so as to obtain at least a partial displacement of the lid portion between its open condition and its closed condition.

28. The method as claimed in claim 27, wherein said opening step further comprises:

engaging the lid portion with at least one grasping member for moving the lid portion from its closed condition to a half-closed condition in which a restricted opening is created between an edge of the lid portion and an edge of the housing portion on a side of each thereof opposite to said hinging side;

directing a first air flow against the lid portion through said restricted opening; and moving the grasping member away from the lid portion to move the lid portion to its open position upon the force of the air flow.

29. The method as claimed in claim 27, wherein said closing step further comprises:

directing an air flow against said lid portion to cause movement of the lid portion from its open condition to its half-closed condition in which a restricted opening is created between an edge of the lid portion and an edge of the housing portion on an opposite side of both thereof with respect to said hinging side; and pressing the case by means of a presser element to cause movement of the lid portion to the closed condition by exerting a mechanical force on the lid portion towards said housing portion.

* * * * *